United States Patent [19]

Sasaya et al.

[11] 3,965,314

[45] June 22, 1976

[54] COLLISION DETECTING SWITCH WITH RECTILINEARLY MOVABLE WEIGHT SENSORS

[75] Inventors: Hideaki Sasaya; Akihiro Kobayashi, both of Aichi, Japan

[73] Assignee: Nippon Soken, Inc., Nishio, Japan

[22] Filed: Oct. 25, 1974

[21] Appl. No.: 518,213

[30] Foreign Application Priority Data

Nov. 13, 1973 Japan ..... 48-131467[U]
Nov. 30, 1973 Japan ..... 48-135107

[52] U.S. Cl. ..... 200/61.53
[51] Int. Cl.[2] ..... H01H 35/14
[58] Field of Search..... 200/61.45, 61.53, 276

[56] References Cited

UNITED STATES PATENTS

| | | | |
|---|---|---|---|
| 1,845,848 | 2/1932 | Richards | 200/61.53 |
| 2,921,999 | 1/1960 | Ziegler, Jr. | 200/61.53 X |
| 3,096,411 | 7/1963 | Chabrek et al. | 200/61.53 |
| 3,742,163 | 6/1973 | Gawlick et al. | 200/61.53 X |
| 3,859,483 | 1/1975 | Laserson et al. | 200/61.53 X |

*Primary Examiner*—James R. Scott
*Attorney, Agent, or Firm*—Cushman, Darby & Cushman

[57] ABSTRACT

There is provided a collision detecting system for an occupant protector comprising at least two terminals, a weight, a spring mechanism arranged between the terminals and adapted to function to change on-off state between the two terminals when an acceleration or deceleration caused by a collision exceeds a predetermined value, and biasing means for biasing the weight to contact with the spring mechanism. The collision detecting system of this invention is suited for installation on both large and small vehicles.

4 Claims, 10 Drawing Figures

COLLISION DETECTING SWITCH WITH RECTILINEARLY MOVABLE WEIGHT SENSORS

BACKGROUND OF THE INVENTION

1. Field of the Invention

The present invention relates to a collision detecting system for an occupant protector, such as a gas bag designed so that the occupant protector is actuated in case of a collision over a certain high speed to secure the occupant in his seat, and more particularly the present invention relates to a collision detecting system of the type adapted for detecting the deceleration of a vehicle in case of a collision.

2. Description of the Prior Art

Conventional detecting systems of the above type have been usually designed so that the weight adapted to be moved upon occurrence of a deceleration strikes against and closes the normally-open contacts, and a current flows through the contacts to actuate the occupant protector. The contacts are also designed so that they are subjected to a certain elastic deformation to ensure the flow of current through the contacts for a predetermined period of time.

However, the known detecting systems constructed as described above is disadvantageous in that while these systems are effective in collisions of larger vehicles where the detection of the collision can be effected at a relatively slow speed, these systems can hardly be of any practical use in collisions of smaller ones where the detection of the collision must be accomplished within a very short period of time following the actual commencement of the collision. In other words, since the contacts must be subjected to a considerably large elastic deformation to ensure the required holding time of the signal for actuating the occupant protector, the detection of the collision will be delayed and moreover it is impossible to accurately determine the magnitude of the collision to be detected. Another disadvantage is the poor reliability of the system, since the system is subject to malfunctions due to causes such as the formation of an oxide layer on the surface of the contacts due to the fact that the circuit is normally opened in the system.

An exemplary form of the conventional collision detecting systems of the type which have the above-mentioned disadvantages is shown in FIG. 1, and in the arrangement shown in FIG. 1*a*, in response to a deceleration due to a collision, a weight 2 which is mounted on a spring 1 moves a movable contact 3. The movable contact 3 is provided with a wedge contact piece 4 so that when the contact piece 4 bites into a stationary contact 5, the circuit between an ignitor 6 and a power source 7 is closed to actuate the ignitor 6 of a gas bag. In this case, the ignitor 6 may for example be other actuating means which requires the flow of a considerably large current, and therefore if there is an oxide layer formed on the surface of the stationary contact 5 or the contact piece 4 or if the contact piece 4 is allowed to contact with the stationary contact 5 only slightly, it is impossible to ensure a reduced electric resistance at the contacting points for a sufficiently long period of time. While, for this reason, the contact piece 4 is adapted to bite into the stationary contact 5 to provide the required signal holding time for maintaining a sufficient current flow, this requires a considerable time before the circuit is completely closed after the occurrence of a collision of the vehicle, thus making it impossible to install the system of this type particularly on smaller vehicles.

FIG. 1*b* is a characteristic diagram showing a typical form of the energizing signal produced in the conventional collision detecting system shown in FIG. 1*a*. In FIG. 1*b*, the curve A shows an exemplary form of the collision deceleration waveform with the abscissa representing the time. The curve B shows the current flow through the contacts 3 and 5 of FIG. 1*a* corresponding to the collision deceleration waveform of the curve A. When a collision occurs at a time $t_0$, the contacts 3 and 5 come into contact at a time $t_1$ at which the flow of current is still insufficient, and it is at a time $t_2$ that the satisfactory final contact is established to achieve a stable conduction state. In other words, the time $t_2 - t_1 = t_G$ is a kind of undetermined factor that arises from the unstable contact between the contacts 3 and 5. Consequently, a considerable time elapses before the flow of current is established between the contacts 3 and 5, thus causing a delay in the detection of the collision. In addition, due to the noise that will be produced by the current flowing before the establishment of the full conduction state, if the system is installed particularly on a smaller vehicle, it is impossible to ensure the positive actuation of the occupant protector. These are phenomena which are bound to happen in the conventional detecting systems.

SUMMARY OF THE INVENTION

With a view to overcoming the foregoing difficulty, it is an object of the present invention to provide a collision detecting system for an occupant protector comprising at least two terminals, a weight adapted to be moved in response to an acceleration or deceleration due to a collision, a spring mechanism arranged between the terminals and responsive to the movement of the weight to change on-off state between the terminals when the acceleration or deceleration of the weight is greater than a predetermined value, and biasing means for biasing the weight to contact with the spring mechanism.

The system provided in accordance with the present invention is well suited for installation on both large and small vehicles, capable of ensuring the required current holding time for the current through the terminals at a predetermined current valve to quickly actuate the occupant protector, also capable of determining the magnitude of collisions, and highly reliable in operation.

BRIEF DESCRIPTION OF THE DRAWINGS

Other objects, features and advantages of the present invention will be apparent from the following description taken in conjunction with the accompanying drawings, in which.

In the drawings, like reference numerals designate like parts or equivalent parts.

DESCRIPTION OF THE PREFERRED EMBODIMENTS

The present invention will now be described in greater detail with reference to the illustrated embodiments.

Figure 2:
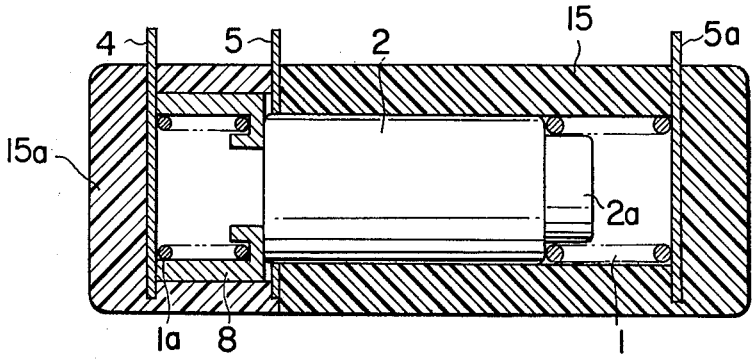
FIG. 2 is a sectional view showing a first embodiment of a collision detecting system according to the present invention.
Figure 3:
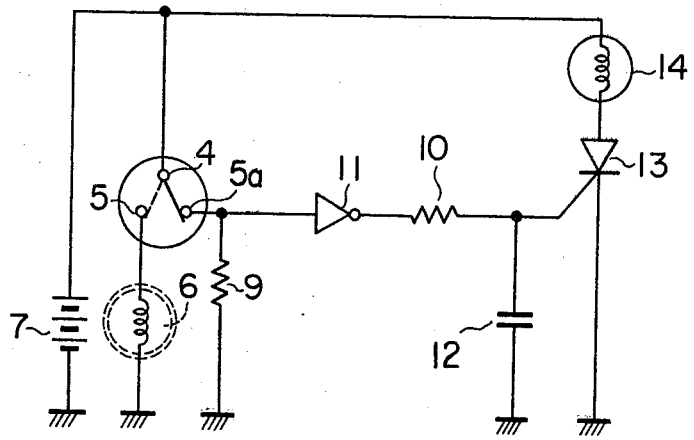
FIG. 3 is a wiring diagram of an electric circuit connected to the collision detecting system of FIG. 2.

Referring now to FIG. 2 showing a first embodiment of the invention, numeral 1 designates a spring constituting biasing means. A cylindrical weight 2 has a cylindrical projection 2*a* and is normally biased to the left in the illustration by the spring 1. Numerals 4, 5 and 5*a* designate terminals with a spring 1*a* and a contact piece 8 being arranged between the terminals 4 and 5. Numerals 15 and 15*a* designate bodies within which the weight 2 and the contact piece 8 are slidable. Each of the springs 1 and 1*a*, the terminals 4, 5 and 5*a* and the weight 2 is made of a conductive material, whereas the bodies 15 and 15*a* are made of non-conductive material such as synthetic resins. The spring force of the spring 1 is selected greater than that of the spring 1*a*, and the contact piece 8 is biased into contact with the weight 2 by the spring 1*a* thus separating the contact piece 8 from the terminal 5. Consequently, when the weight 2 is moved to the right in the illustration, the contact piece 8 is also moved to the right in the illustration by the spring force of the spring 1*a* to follow the movement of the weight 2. The terminal 5 also serves as a stopper that limits the amount of movement of the contact piece 8. Thus, while the movement of the weight 2 under the effect of a high acceleration or deceleration due to a collision causes the contact piece 8 to move as described above, the extent of its movement is up to the terminal 5. When this occurs, an electrically conductive path is established between the terminals 4 and 5 through the spring 1*a* and the contact piece 8. Here, the spring 1*a* and the contact piece 8 constitute a spring mechanism. Further, the terminals 4, 5 and 5*a* are connected to the electric circuit shown in FIG. 3, and an indicator such as a lamp is connected in the circuit including the terminals 4 and 5*a* so that it is possible to detect the breaking of the springs 1 and 1*a* and any contact fault in various parts of the system. In FIG. 3, numerals 9 and 10 designate resistors. Also illustrated are an inverter 11, a capacitor 12, a silicon controlled rectifier 13, and a lamp 14.

Figure 1A:
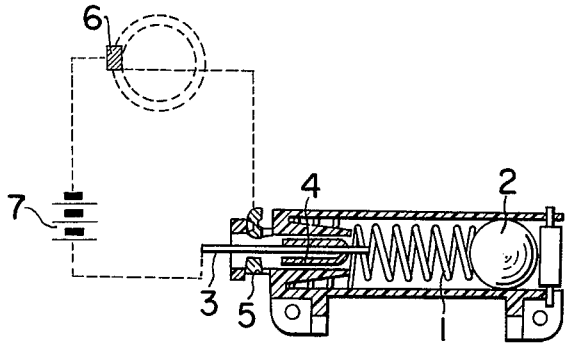
FIG. 1a PRIOR ART
FIG. 1*a* is a sectional view showing the construction of a prior art collision detecting system.
Figure 1B:
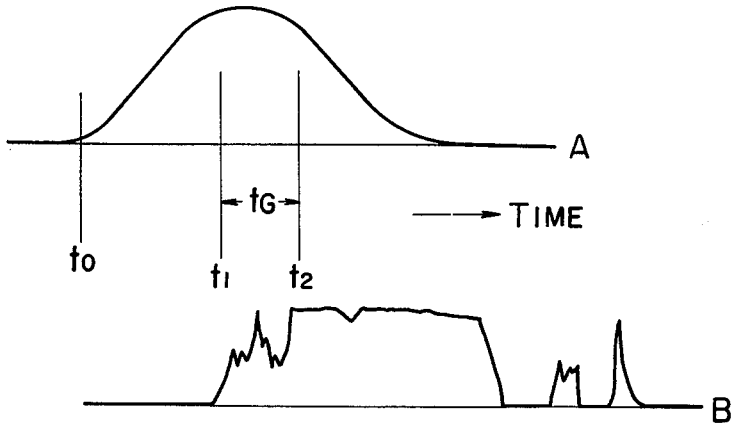
FIG. 1b PRIOR ART
FIG. 1*b* is a characteristic diagram showing the current signal through the terminals of the system of FIG. 1*a* corresponding to the acceleration or deceleration of the weight.
Figure 4:
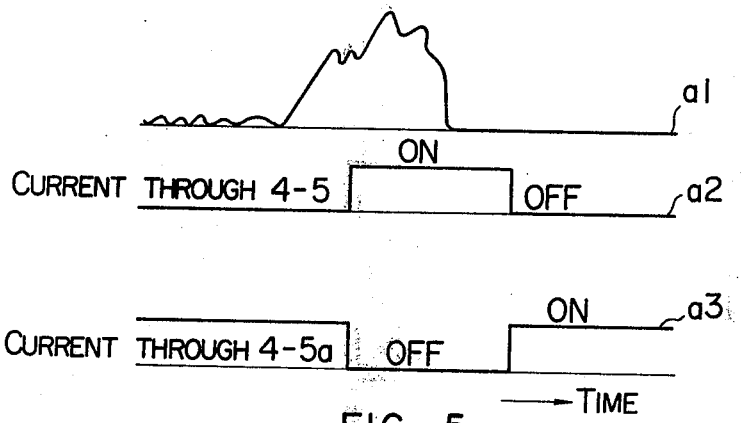
FIG. 4 is a characteristic diagram showing the relationship between the conduction and non-conduction of current through the terminals and the acceleration/deceleration waveform in the system of the invention shown in FIG. 2.

With the construction described above the system according to the first embodiment of the invention operates as follows. Before the occurrence of a collision, an electrical circuit is established between the terminals 4 and 5*a* through the spring 1*a*, the contact piece 8, the weight 2 and the spring 1. Thus, if there is a contact fault between the springs 1 and 1*a*, the weight 2 and the contact piece 8, the lamp 14 or indicator in the closed circuit of the terminals 4 and 5*a* will come into operation to detect the existence of the faulty condition of the component parts provided between the terminals 4 and 5*a*. On the other hand, when the weight 2 is subjected to an acceleration or deceleration in a collision, the weight 2 is moved to the right in FIG. 2 against the force of the spring 1, and the contact piece 8 also moved to follow the movement of the weight 2, comes into contact with the terminal 5 thus completing an electric circuit between the terminal 4 and the terminal 5 through the spring 1*a* and the contact piece 8. This energizes an ignitor or electric detonator 6 provided in the closed circuit comprising the terminals 4 and 5. Thereafter, when the acceleration or deceleration diminishes so that the spring force of the spring 1 overcomes the force due to the acceleration or deceleration, the weight 2 is forced back by the spring force of the spring 1 and the weight 2 again comes into contact with the contact piece 8, thus opening the electric circuit between the terminals 4 and 5. In FIG. 4, a curve $a_1$ shows a waveform of the deceleration imparted to the weight 2, a curve $a_2$ the waveform of the current flow through the terminals 4 and 5, and a curve $a_3$ the waveform of the current flow through the terminals 4 and 5*a*. More specifically, the "ON" region of the curve $a_2$ indicates the establishment of an electric circuit between the terminals 4 and 5 through the spring 1*a* and the contact 8 and the "OFF" region indicates the reverse condition, while on the other hand the OFF region of the curve $a_3$ indicates the opening of the contact between the weight 2 and the contact piece 8. In this case, a comparative analysis of the curves $a_1$, $a_2$ and $a_3$ show that there is no unstable period corresponding to the unstable time $t_G$ in FIG. 1*b*. It will also be seen that the ON condition of the curve $a_2$ and the OFF condition of the curve $a_3$ continue even after the termination of the deceleration of the curve $a_1$. This indicates that even after the termination of the deceleration, the weight 2 must return a certain distance to come into contact again with the contact piece 8, that is, there is a certain delay. Consequently, a considerable current holding time for the current flow through the terminals 4 and 5 is obtained, thus making it possible to positively actuate the gas bag as the occupant protector. Further, since the actuation of the gas bag is accomplished through the complete on-off control of the circuit connections between the respective terminals, it is possible to ensure a quick actuation of the gas bag. Further, while the weight 2 is adapted to remain in contact with the contact piece 8 until the contact piece 8 is moved into contact with the terminal 5 by the spring 1*a* and the weight 2 separates from the contact piece 8 only after the contact piece 8 has contacted the terminal 5, the effect of this is that the collision detecting system is prevented from being operated erroneously in response to the application of a high frequency, relative low acceleration or deceleration due to a collision at low speed, the vibration of the vehicle or the like. In other words, when the system is subjected to a relatively low acceleration or deceleration as in the case of a collision at low speed, even if the weight 2 were moved against the force of the spring 1, the weight 2 would return to the initial position before the contact piece 8 could come into contact with the terminal 5, and consequently no electric circuit is established between the terminals 4 and 5. Therefore, the electric circuit between the terminals 4 and 5 is completed only when there is an acceleration or deceleration greater than a certain value.

Figure 5:
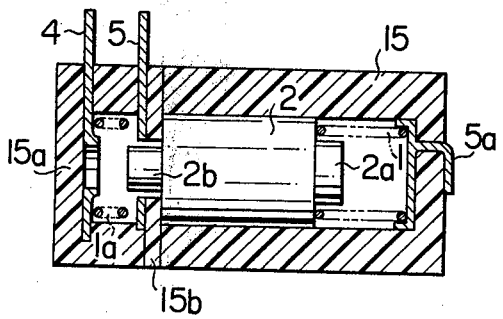
FIG. 5 is a sectional view showing a second embodiment of the collision detecting system according to the present invention.

FIG. 5 illustrates a second embodiment of the invention in which the contact piece 8 used in the embodiment of FIG. 2 is eliminated, and the front end of the weight 2 is projected to form a plane projection 2*b* which penetrates a body 15*b*, thus directly contacting with the spring 1*a*. The operation of the second embodiment is identical with that of the first embodiment.

Figure 6:
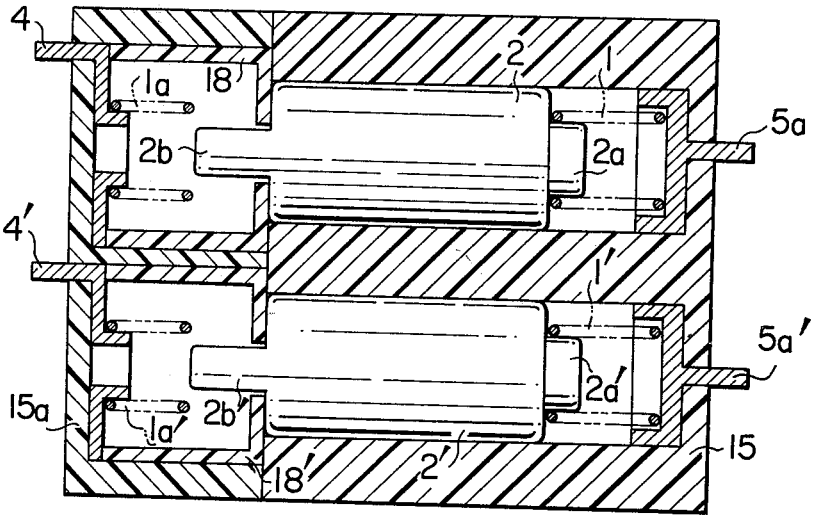
FIG. 6 is a sectional view showing a third embodiment of the collision detecting system according to the present invention.
Figure 7:
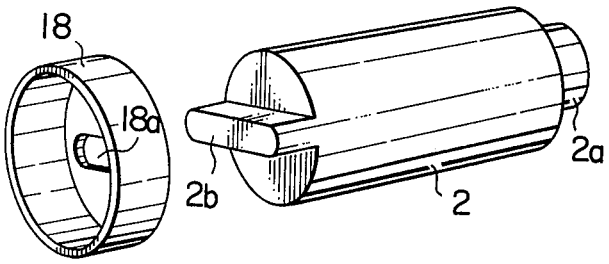
FIG. 7 is a partial perspective view of the collision detecting system in FIG. 6.

The third embodiment as shown in FIGS. 6 and 7 comprises two each components and is so constructed that the collision is detected by an electrical interruption between two terminals thereby to actuate the occupant protector. In the embodiment, stoppers 18 and 18' are made of synthetic resins and limit the movement of springs 1*a* and 1*a'* toward the right in the figure. The weight 2 is provided with plane projections 2*a* and 2*a'* as shown in FIG. 7 similarly as in the second embodiment. The stopper 18 is provided with a through-hole 18*a* which a plane projection 2*b* penetrates. A weight 2' and the stopper 18' are formed similarly with the weight 2 and the stopper 18. One ends of the springs 1*a* and 1*a'* contact with the plane projections 2*b* and 2*b'* of the weights 2 and 2' and when the collision occurs the contacts therebetween are broken by the stoppers 18 and 18' so that electrical connections between terminals 4 and 5*a* and between terminals 4' and 5*a'* are interrupted. In the embodiment, if the two collision detection mechanisms are connected in parallel with an electrical circuit for actuating the occupant protector, the occupant protector can be actuated upon the detection of the collision even if either collision detection mechanism goes wrong owing to breaking of the spring and lacks of connection on connecting portions.

The actuation of the occupant protector upon the electrical interruption between the two terminals is simple and there is made no detailed explanations concerning the actuation of the occupant protector.

Figure 8:
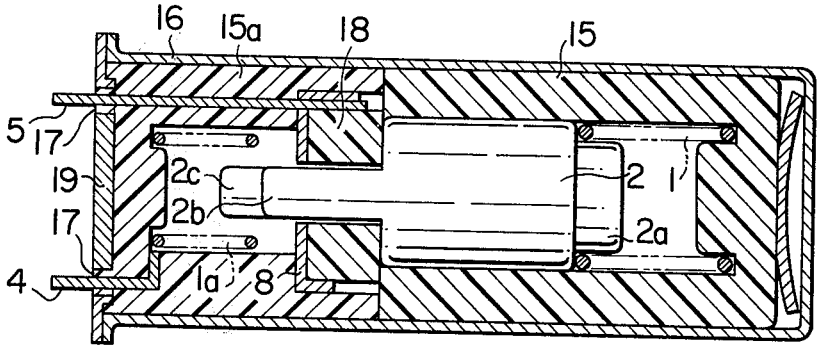
FIG. 8 is a sectional view showing a fourth embodiment of the collision detecting system according to the present invention.
Figure 9:
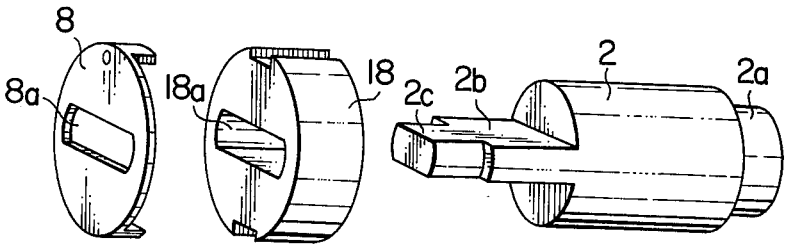
FIG. 9 is a partial perspective view of the collision detecting system according to the present invention.

Referring now to the fourth embodiment as shown in FIGS. 8 and 9, a terminal 4 in contact with a spring 1*a'* extends through the body 15*a*, and a terminal 5 is connected to the contact piece 8 by soldering or the like. Coplanar projections 2*b* and 2*c* forming two steps are provided on one end of the weight 2 and the projection 2*b* serves to disconnect the spring 1*a* from the contact piece 8. The contact piece 8 is fixed between a stopper 18 and the body 15*a*. The contact piece 8 and the stopper 18 are provided respectively with apertures 8*a* and 18*a* through which the projections 2*b* and 2*c* penetrate. In this embodiment, the spring 1 is constructed to have a larger spring force than the spring 1*a*, so that the same operation as described with respect to the embodiments of FIGS. 2 and 5 is obtained upon the occurrence of a collision. In this embodiment, numeral 16 designates an open ended cylindrical metal housing. All of the components are contained therein by a metal lid 19 welded to the housing at its open end. In this case, the terminals 4 and 5 are insulated from the lid by an insulating member 17.

In the afore-mentioned first, second and third embodiments, it is also possible to fix each components by using the metal coating and it is desirable to hermetically seal each components within the bodies 15, 15*a* and 15*b* with filling a gas ($H_2$ : Ne = 9 : 1 in volume) therein in order to prevent the formation of any oxide film on the conductive members and each connection portions.

While, in the embodiments of the present invention described hereinbefore, the spring 1 is provided as a means for biasing the weight 2, the present invention is not limited thereto and it is possible to use magnets so that the weight 2 is biased by the repulsion of the same poles of the magnets.

It will thus be seen from the foregoing description that since the collision detecting system of this invention comprises at least two terminals, a weight movable in response to an acceleration or deceleration, a spring mechanism arranged between the terminals and responsive to the movement of the weight to change on-off stage between the terminals when the acceleration or deceleration of the weight is greater than a predetermined value, and biasing means for biasing the weight to contact with the spring mechanism, there is a great advantage that a considerably long holding time is ensured for the current flow through the terminals at a predetermined current value, thus making it possible to rapidly and positively actuate the occupant protector. There is a further great advantage that by virtue of the fact that the electric circuit between the terminals is not completed unless the acceleration or deceleration due to a collision is greater than a predetermined value, it is possible to determine the magnitude of collisions, that is, it is possible to make a distinction between high and low speed collisions. A still further great advantage of the system of this invention is that it is capable of detecting its faulty conditions.

What is claimed is:

1. A collision detecting system comprising:

a housing; and a switch contained within said housing, said switch including:

a weight slidably movable within the housing;

a first spring located within the housing and arranged in contacting relationship with said weight to urge the weight to slide in a first direction;

a second spring located within said housing and arranged in contacting relationship with said weight to urge the weight to slide in a second direction opposite to said first direction, said second spring exerting a force on said weight less than that exerted on the weight by said first spring;

a pair of terminals mounted in spaced relationship in said housing, said terminals having a state of electrical interconnection dependent on the position of said second spring; and means within said housing for restricting expansion of said second spring when the weight is moved in said second direction in response to a force imparted to the weight in excess of a predetermined value whereby contact between the weight and the second spring is interrupted causing the state of electrical interconnection of the terminals to be altered.

2. A collision detecting system according to claim 1, further comprising:

a third terminal mounted in said housing in spaced relationship with respect to said pair of terminals; and circuit means including said third terminal and one of said pair of terminals for detecting a fault condition of said switch in response to a state of electrical interconnection between the third terminal and said one terminal.

3. A collision detecting system according to claim 1, wherein said weight is provided at one end thereof with a projection adapted to partially abut said second spring and wherein said expansion restricting means comprises a stopper within said housing through which said projection extends when the force imparted to said weight is less than said predetermined value.

4. A collision detecting system according to claim 1, further comprising an additional one of said switches contained within the housing.

* * * * *